US008105739B2

(12) United States Patent
Yamada et al.

(10) Patent No.: US 8,105,739 B2
(45) Date of Patent: Jan. 31, 2012

(54) ELECTROPHOTOGRAPHIC PHOTORECEPTOR, PROCESS CARTRIDGE, AND IMAGE FORMING APPARATUS

(75) Inventors: Wataru Yamada, Kanagawa (JP); Katsumi Nukada, Kanagawa (JP); Yukiko Furushiro, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 887 days.

(21) Appl. No.: 12/053,996

(22) Filed: Mar. 24, 2008

(65) Prior Publication Data

US 2008/0254380 A1 Oct. 16, 2008

(30) Foreign Application Priority Data

Apr. 12, 2007 (JP) ..... 2007-105125

(51) Int. Cl.
*G03G 5/00* (2006.01)

(52) U.S. Cl. ..... 430/59.1; 430/58.05; 430/59.4; 430/69

(58) Field of Classification Search ..... 430/56, 430/58.05, 59.1, 59.4, 69
See application file for complete search history.

(56) References Cited

U.S. PATENT DOCUMENTS

| | | | | |
|---|---|---|---|---|
| 5,298,617 | A | 3/1994 | Nukada et al. | |
| 5,302,479 | A | 4/1994 | Daimon et al. | |
| 5,352,555 | A | 10/1994 | Yagi et al. | |
| 5,459,004 | A | 10/1995 | Katsumi et al. | |
| 5,545,733 | A | 8/1996 | Daimon et al. | |
| 7,727,692 | B2 * | 6/2010 | Yamada et al. | 430/69 |
| 2003/0194625 | A1 | 10/2003 | Tanaka et al. | |
| 2006/0013616 | A1 | 1/2006 | Nukada et al. | |
| 2006/0014091 | A1 * | 1/2006 | Nukada et al. | 430/60 |

FOREIGN PATENT DOCUMENTS

| | | | |
|---|---|---|---|
| CN | 1722007 | A | 1/2006 |
| CN | 1759349 | A | 4/2006 |
| EP | 0 710 893 | A1 | 5/1996 |
| EP | 1688465 | | 8/2006 |
| JP | A-47-30330 | | 11/1972 |
| JP | 56047045 | A * | 4/1981 |
| JP | A-4-189873 | | 7/1992 |
| JP | A-5-43813 | | 2/1993 |
| JP | A-5-98181 | | 4/1993 |
| JP | A-5-140472 | | 6/1993 |
| JP | A-5-140473 | | 6/1993 |
| JP | A-5-263007 | | 10/1993 |
| JP | A-5-279591 | | 10/1993 |
| JP | A-6-138681 | | 5/1994 |
| JP | A-6-222595 | | 8/1994 |
| JP | A-7-53892 | | 2/1995 |
| JP | A-8-176293 | | 7/1996 |
| JP | A-8-208820 | | 8/1996 |
| JP | A-11-38656 | | 2/1999 |
| JP | A-2002-6527 | | 1/2002 |
| JP | A-2002-82466 | | 3/2002 |
| JP | A-2002-82469 | | 3/2002 |
| JP | A-2003-186215 | | 7/2003 |
| JP | A-2003-186234 | | 7/2003 |

OTHER PUBLICATIONS

JP 56047045 (English Abstract) Apr. 1981.*

(Continued)

*Primary Examiner* — Mark F Huff
*Assistant Examiner* — Stewart Fraser
(74) *Attorney, Agent, or Firm* — Oliff & Berridge, PLC

(57) ABSTRACT

An electrophotographic photoreceptor includes a conductive support and a photosensitive layer. The photosensitive layer is disposed on the conductive support, and includes a layer that includes, in the same layer, at least a charge generating material and a compound having a triple bond and a hydroxy group.

14 Claims, 6 Drawing Sheets

OTHER PUBLICATIONS

English Translation of JP 56047045A.*

Office Action from U.S. Appl. No. 11/714,895 mailed Apr. 17, 2009.

Office Action from U.S. Appl. No. 11/714,895 mailed Nov. 27, 2009.

Chinese Office Action with English Translation; mailed Aug. 28, 2009.

Daimon et al., "A New Polymorph of Hydroxygallium Phthalocyanine and Its Application in a Photoreceptor," Journal of Imaging Science and Technology, vol. 40, No. 3, pp. 249-253, May 1996.

Jan. 26, 2011 Chinese Office Action issued in Chinese Patent Application No. 200810088627.1.

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATION

This application is based on and claims priority under 35 USC 119 from Japanese patent Application No. 2007-105125 filed on Apr. 12, 2007.

BACKGROUND

1. Technical Field

The present invention relates to an electrophotographic photoreceptor, a process cartridge, and an image forming apparatus.

2. Related Art

In recent years, efforts have been made to improve the speed and the reliability of image forming apparatuses of so-called xerography system, which has a charging unit, an exposure unit, a development unit, a transfer unit, and a fixing unit, through technical developments of the respective members and the system. Therefore, requirements for high-speed adaptability and high reliability of each subsystem are stronger than before. With respect to toners used in the image forming apparatuses, there have been attempts to, for example, reduce the particle diameter of the toner, decrease the particle diameter, make uniform the particle size distribution (reduce the particle size variation), and make the toner particles spherical. As a toner which meets such requirements in quality, a toner produced in a solvent composed mainly of water, or so-called chemical toner has been developed actively.

In particular, electrophotographic photoreceptors used for image writing are strongly required to have high-speed adaptability and high reliability. In order to achieve high-speed adaptability and high reliability, in particular, research and development regarding charge generating materials have been actively conducted. For example, a lot of reports have been made on the relationship between crystal forms and electrophotographic characteristics of phthalocyanine compounds, which are known as charge generating materials used in electrophotographic photoreceptors.

It is generally known that phthalocyanine compounds are classified into several crystal forms depending on their production method or treating method, and that the difference in crystal form significantly influences the photoelectric conversion characteristics of the phthalocyanine compounds. With respect to the crystal forms of nonmetal phthalocyanine crystals, crystal forms such as α, β, π, γ, and X forms are known.

SUMMARY

According to an aspect of the invention, there is provided an electrophotographic photoreceptor having a conductive (electro-conductive) support and a photosensitive layer. The photosensitive layer is disposed on the conductive support, and includes a layer that includes, in the same layer, at least a charge generating material and a compound having a triple bond and a hydroxy group.

BRIEF DESCRIPTION OF THE DRAWINGS

Exemplary embodiments of the present invention will be described in detail based on the following figures, wherein.

DETAILED DESCRIPTION (Electrophotographic Photoreceptor)

The electrophotographic photoreceptor in accordance with an exemplary embodiment of the present invention includes a conductive support and a photosensitive layer, wherein the photosensitive layer is provided on the conductive support, and includes a layer containing at least a charge generating material and a compound having a triple bond and a hydroxy group in the same layer.

The electrophotographic photoreceptor is further described in detail below with reference to the drawings.

Figure 1:
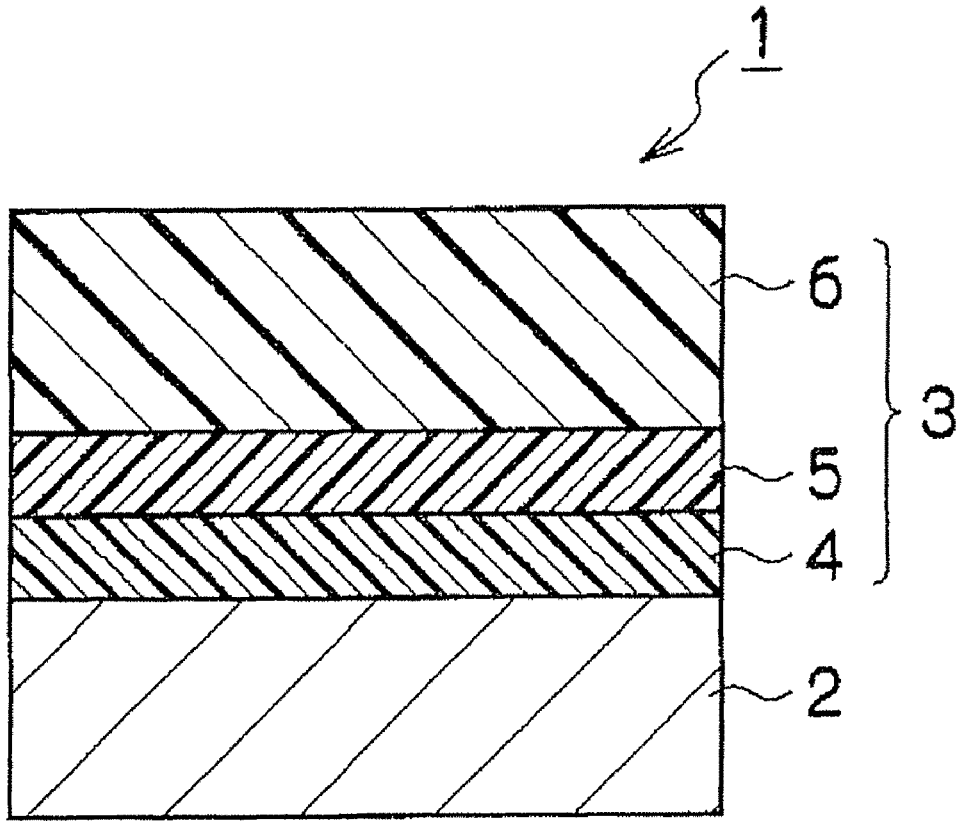
FIG. 1 is a schematic cross sectional view showing an electrophotographic photoreceptor in accordance with an exemplary embodiment of the present invention.

FIG. 1 is a schematic cross sectional view showing the electrophotographic photoreceptor in accordance with the exemplary embodiment of the invention. Electrophotographic photoreceptor 1 shown in FIG. 1 includes conductive support 2 and photosensitive layer 3. Photosensitive layer 3 is provided on conductive support 2, and includes undercoat layer 4, charge generating layer 5, and charge transporting layer 6 laminated in this order. In electrophotographic photoreceptor 1 shown in FIG. 1, charge generating layer 5 corresponds to the layer containing at least a charge generating material and a compound having a triple bond and a hydroxy group in the same layer.

The electrophotographic photoreceptor in accordance with the exemplary embodiment of the invention may have, although not shown: 1) a structure having an undercoat layer, a charge generating layer, a charge transporting layer, and a protective layer provided, as a photosensitive layer, in this order on a conductive support; 2) a structure having an undercoat layer, a charge transporting layer, a charge generating layer, and a protective layer provided, as a photosensitive layer, in this order on a conductive support; 3) a structure having an undercoat layer and a photosensitive layer composed of a single layer provided, as a photosensitive layer, in this order on a conductive support; or 4) a structure having an undercoat layer, a photosensitive layer composed of a single layer, and a protective layer provided, as a photosensitive layer, in this order on a conductive support. In the structures having a photosensitive layer composed of a single layer, the single photosensitive layer corresponds to the layer containing at least a charge generating material and a compound having a triple bond and a hydroxy group in the same layer.

The components of the electrophotographic photoreceptor 1 shown in FIG. 1 are further described below.

Examples of conductive support 2 include a metal plate, metal drum, or metal belt including a metal such as aluminum, copper, zinc, stainless steel, chromium, nickel, molybdenum, vanadium, indium, gold, or platinum, or an alloy thereof. As an alternative, conductive support 2 may be a paper, plastic film, or belt coated, deposited, or laminated with a conductive compound such as a conductive polymer or indium oxide, a metal such as aluminum, palladium, or gold, or an alloy thereof. The term "conductive" used herein refers to a volume resistivity of less than $10^{13}$ Ωcm.

The surface of conductive support 2 may be roughened so as to prevent interference fringes generated during laser beam irradiation. The degree of roughening is, for example, a ten-point average roughness (Rz) in the range of from 0.04 μm to 0.5 μm. If the ten-point average roughness (Rz) of the surface of conductive support 2 is less than 0.04 μm, the surface resembles a mirror, thus is unlikely to provide sufficient interference-preventing effects. On the other hand, if the ten-point average roughness (Rz) is more than 0.5 μm, the image quality tends to be insufficient even if coating film is provided. When incoherent light is used as the light source, roughening for preventing interference fringes is not particularly required; therefore, the service life may be elongated due to prevention of defects caused by unevenness on the surface of conductive support 2.

The method for roughening is, for example, a wet honing method in which an aqueous suspension of an abrasive is blown to the support, a centerless grinding method in which the support is pressed against a rotating grind stone and ground continuously, or an anodization treating method.

Another method for roughening does not involve roughening of the surface of conductive support 2, but includes dispersing a conductive or semiconductive powder in a resin to form a layer on the support surface, and roughened surface is provided by the particles dispersed in the layer.

The anodization treatment involves anodization in an electrolyte solution with aluminum as anode thereby forming an oxide film on the aluminum surface. Examples of the electrolyte solution include a sulfuric acid solution and an oxalic acid solution. However, an untreated porous anodized film is chemically active and susceptible to contamination, and shows significant environmental variation in the electric resistance. On this account, it is possible to convert the film to a more stable hydrous oxide through micropore sealing treatment in which the fine pores in the anodized film are sealed by volume expansion caused by hydration reaction in pressurized water vapor or boiling water, which may contain a metal salt such as a nickel salt.

The thickness of the anodized film may be in the range of from 0.3 μm to 15 μm. If the film thickness is less than 0.3 μm, barrier characteristics against injection are so poor that the effect of the film tends to be insufficient. On the other hand, if the film thickness is more than 15 μm, residual potential tends to be increased by repeated use.

Conductive support 2 may be treated with an acidic aqueous solution or boehmite. Treatment with an acidic treatment liquid containing phosphoric acid, chromic acid, and hydrofluoric acid is carried out as follows. In the first place, an acidic treatment liquid is prepared. The mixing ratio of phosphoric acid in the acidic solution may be in the range of from 10% by weight to 11% by weight. The mixing ratio of chromic acid in the acidic solution may be in the range of from 3% by weight to 5%. The mixing ratio of hydrofluoric acid in the acidic solution may be in the range of from 0.5% by weight to 2% by weight. The total concentration of the acids may be in the range of from 13.5% by weight to 18% by weight. The treatment temperature may be in the range of 42° C. to 48° C. By keeping a high treatment temperature, a thicker film is formed more quickly. The film thickness may be in the range of from 0.3 μm to 15 μm. If the film thickness is less than 0.3 μm, barrier characteristics against injection are so poor that the effect of the film tends to be insufficient. On the other hand, if the film thickness is more than 15 μm, residual potential tends to be increased by repeated use.

Boehmite treatment is carried out by immersing the support in pure water at a temperature in the range of from 90° C. to 100° C. for a period in the range of from 5 minutes to 60 minutes, or exposing the support to heated water vapor at a temperature in the range of from 90° C. to 120° C. for a period in the range of from 5 minutes to 60 minutes. The film thickness may be in the range of from 0.1 μm (or about 0.1 μm) to 5 μm (or about 5 μm). The film may be further subjected to anodization treatment using an electrolyte solution which scarcely dissolves the film (for example, adipic acid, boric acid, borate, phosphate, phthalate, maleate, benzoate, tartrate, or citrate).

Undercoat layer 4 is formed on conductive support 2. Undercoat layer 4 includes, for example, an organic metal compound and/or a binder resin.

Examples of the organic metal compound include organic zirconium compounds such as zirconium chelate compounds, zirconium alkoxide compounds, and zirconium coupling agents; organic titanium compounds such as titanium chelate compounds, titanium alkoxide compounds, and titanate coupling agents; organic aluminum compounds such as aluminum chelate compounds and aluminum coupling agents; antimony alkoxide compounds; germanium alkoxide compounds; indium alkoxide compounds; indium chelate compounds; manganese alkoxide compounds; manganese chelate compounds; tin alkoxide compounds; tin chelate compounds; aluminum silicon alkoxide compounds; aluminum titanium alkoxide compounds; and aluminum zirconium alkoxide compounds.

The organic metal compound may be an organic zirconium compound, an organic titanyl compound, or an organic aluminum compound because the use of such a compound results in a low residual potential and improved electrophotographic characteristics.

Examples of the binder resin include known binder resins such as polyvinyl alcohol, polyvinyl methyl ether, poly-N-vinylimidazole, polyethylene oxide, ethyl cellulose, methyl cellulose, ethylene-acrylic acid copolymer, polyamide, polyimide, casein, gelatin, polyethylene, polyester, phenolic resin, vinyl chloride-vinyl acetate copolymer, epoxy resin, polyvinylpyrrolidone, polyvinylpyridine, polyurethane, polyglutamic acid, and polyacrylic acid. When two or more of these binder resins are used in combination, the mixing ratio may be selected in accordance with the necessity.

Undercoat layer 4 may contain a silane coupling agent such as vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane, or β-3-3,4-epoxycyclohexyltrimethoxysilane.

Undercoat layer 4 may contain an electron-transporting pigment mixed/dispersed therein, from the viewpoint of environmental stability or decrease in residual potential. Examples of the electron-transporting pigment include organic pigments (e.g., those described in JP-A No. 47-30330), such as perylene pigments, bisbenzimidazole perylene pigments, polycyclic quinone pigments, indigo pigments, and quinacridone pigments; organic pigments (e.g., bisazo pigments and phthalocyanine pigments) having an electron-withdrawing substituent such as a cyano group, a nitro group, a nitroso croup, or a halogen atom; and inorganic pigments such as zinc oxide and titanium oxide.

Among these pigments, perylene pigments, bisbenzimidazole perylene pigments, polycyclic quinone pigments, zinc oxide, and titanium oxide are preferable because they exhibit higher electron mobility than other pigments.

The surface of these pigments may be treated with any of the above-mentioned coupling agents, a binder resin, or the like for the purpose of controlling the dispersibility and charge transporting characteristics.

If the amount of the electron transporting pigment is too large, the strength of undercoat layer 4 is reduced to cause defects of the coating. Therefore, the amount of the pigment is preferably 95% by weight or less, more preferably 90% by weight or less, with respect to the total solid content of undercoat layer 4.

It is possible to add to undercoat layer 4 fine powder of various organic compounds or inorganic compounds for the purpose of, for example, improving electrical characteristics or light scattering characteristics. In particular, for example, white pigments such as titanium oxide, zinc oxide, Chinese white, zinc sulfide, lead white, and lithopone, inorganic pigments as body pigments such as alumina, calcium carbonate, and barium sulfate, polytetrafluoroethylene resin particles, silicone fine particles, benzoguanamine resin particles, and styrene resin particles are effective.

The fine powder to be added may have a volume average particle diameter in the range of from 0.01 μm to 2 μm. The fine powder is added as necessary, and the amount is preferably in the range of from 10% by weight to 90% by weight, more preferably from 30% by weight to 80% by weight, with respect to the total solid content in undercoat layer 4.

Undercoat layer 4 may include a binder resin containing inorganic particles and silicone resin particles. The undercoat layer 4 having this structure is preferable in terms of electrical characteristics, leak resistance, and prevention of interference fringes. However, the structure tends to cause coating defects when the charge generating layer is formed thereon as an upper layer. The generation of such coating defects may be suppressed when the specific charge generating layer described below is formed on undercoat layer 4 having the above structure.

Undercoat layer 4 is formed using a coating solution for forming an undercoat layer, the coating solution containing the components described above. The organic solvent used in the coating solution for forming an undercoat layer may be an organic solvent which dissolves an organic metal compound and a binder resin, and will not cause gelation or aggregation when the electron-transporting pigment is mixed and/or dispersed.

Examples of the organic solvent include common ones such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. In an exemplary embodiment, only one organic solvent is used. In another exemplary embodiment, a mixture of two or more organic solvents is used.

Regarding the method of mixing and/or dispersing the components, it is possible to use a common method using, for example, a ball mill, a roll mill, a sand mill, an attritor, a vibration ball mill, a colloid mill, a paint shaker, or ultrasound. The mixing and/or dispersing may be conducted in an organic solvent.

The coating method for forming undercoat layer 4 may be an ordinary method such as blade coating, wire bar coating, spray coating, dip coating, bead coating, air knife coating, or curtain coating.

Drying is conducted usually at a temperature at which a film is formed by the evaporation of the solvent. In particular, because conductive support 2 treated with an acidic solution or boehmite tends to have an insufficient ability to mask defects on the base material, it is preferable to form undercoat layer 4.

The film thickness of undercoat layer 4 is preferably in the range of from 0.01 μm to 30 μm, more preferably from 0.05 μm to 25 μm.

The charge generating layer 5 contains at least a charge generating material and a compound having a triple bond and a hydroxy group, and may additionally contain, as necessary, a binder resin.

The compound having a triple bond and a hydroxy group is a compound having within a molecule thereof a triple bond and a hydroxy group. Examples of the compound include 2-propyne-1-ol, 1-butyne-3-ol, 2-butyne-1-ol, 3-butyne-1-ol, 1-pentyne-3-ol, 2-pentyne-1-ol, 3-pentyne-1-ol, 4-pentyne-1-ol, 4-pentyne-2-ol, 1-hexyne-3-ol, 2-hexyne-1-ol, 3-hexyne-1-ol, 5-hexyne-1-ol, 5-hexyne-3-ol, 1-heptyne-3-ol, 2-heptyne-1-ol, 3-heptyne-1-ol, 4-heptyne-2-ol, 5-heptyne-3-ol, 1-octyne-3-ol, 1-octyne-3-ol, 3-octyne-1-ol, 3-nonyne-1-ol, 2-decyne-1-ol, 3-decyne-1-ol, 10-undecyne-1-ol, 3-methyl-1-butyne-3-ol, 3-methyl-1-pentene-4-yne-3-ol, 3-methyl-1-pentyne-3-ol, 5-methyl-1-hexyne-3-ol, 3-ethyl-1-pentyne-3-ol, 3-ethyl-1-heptyne-3-ol, 4-ethyl-1-octyne-3-ol, 3,4-dimethyl-1-pentyne-3-ol, 3,5-dimethyl-1-hexyne-3-ol, 3,6-dimethyl-1-heptyne-3-ol, 2,2,8,8-tetramethyl-3,6-nonadiyne-5-ol, 4,6-nonadecadiyne-1-ol, 10,12-pentacosadiyne-1-ol, 2-butyne-1,4-diol, 3-hexyne-2,5-diol, 2,4-hexadiyne-1,6-diol, 2,5-dimethyl-3-hexyne-2,5-diol, 3,6-dimethyl-4-octyne-3,6-diol, 2,4,7,9-tetramethyl-5-decyne-4,7-diol, (+)-1,6-bis(2-chlorophenyl)-1,6-diphenyl-2,4-hexadiyne-1,6-diol, (−)-1,6-bis(2-chlorophenyl)-1,6-diphenyl-2,4-hexadiyne-1,6-diol, 2-butyne-1,4-diol bis(2-hydroxyethyl), 1,4-diacetoxy-2-butyne, 4-diethylamino-2-butyne-1-ol, 1,1-diphenyl-2-propyne-1-ol, 1-ethynyl-1-cyclohexanol, 9-ethynyl-9-fluorenol, 2,4-hexadiynediyl-1,6-bis(4-phenylazobenzenesulfonate), 2-hydroxy-3-butynoate, ethyl 2-hydroxy-3-butynoate, 2-methyl-4-phenyl-3-butyne-2-ol, methylproparagyl ether, 5-phenyl-4-pentyne-1-ol, 1-phenyl-1-propyne-3-ol, 1-phenyl-2-propyne-1-ol, 4-trimethyl silyl-3-butyne-2-ol, and 3-trimethylsilyl-2-propyne-1-ol.

Other examples of the compound having a triple bond and a hydroxy group include a compound obtained by replacing at least a portion of any one of the above-mentioned exemplary compounds by a polyether (such as ethylene oxide).

Among these compounds, the compound having a triple bond and a hydroxy group may be a compound represented by the following formula (A-1). This compound more effectively improves the dispersibility of the charge generating material, whereby the effect of supporting charge transportation becomes more significant in comparison with other compounds.

(A-1)

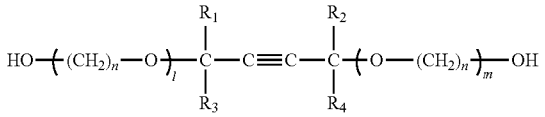

In Formula (A-1), l and m each independently represent an integer of 0 or greater, n represents a natural number, and $R_1$, $R_2$, $R_3$, and $R_4$ each independently represent a monovalent organic group.

In Formula (A-1), $R_1$, $R_2$, $R_3$, and $R_4$ each preferably represent an alkyl group, more preferably an alkyl group having 1 to 20 (or 1 to about 20) carbon atoms. In an exemplary embodiment, at least one of $R_1$, $R_2$, $R_3$, and $R_4$ represents a branched alkyl group. It is preferable that l and m are each independently 300 or less (or about 300 or less). n is preferably a natural number in the range of from 0 to 100 (or from 0 to about 100). The reason why the compound exhibits favorable characteristics is not known, but is presumed as follows by the inventors: an alkylene glycol, a hydroxyl group, or a triple bond decreases surface tension, wherein those having l and m of 300 or less are preferable because they are particularly high in solubility in the coating solution, affinity for components of the coating solution, and dispersion stability, and, when the compound has a branched alkyl group, the branched alkyl group imparts appropriate hydrophobicity to the compound thereby increasing the compatibility with the coating solution and efficiently improving the dispersibility of the coating solution.

The content of the compound having a triple bond and a hydroxy group is preferably in the range of from 0.01% (or about 0.01%) by weight to 10% (or about 10%) by weight, more preferably from 0.1% (or about 0.1%) by weight to 0.5% (or about 0.5%) by weight with respect to the total solid content of charge generating layer 5. If the content of the compound having a triple bond and a hydroxy group is less than 0.01% by weight, the effect of improving dispersibility tends to be insufficient. On the other hand, if the content of the compound having a triple bond and a hydroxy group is more than 10% by weight, problems may occur in that the compound may ooze and thus causes coating film defects such as cissing during formation of an upper layer.

The charge generating material may be selected, without particular limitations, from known charge generating materials such as organic pigments (for example, azo pigments such as bisazo and trisazo pigments, fused aromatic pigments such as dibromoanthanthrone, perylene pigments, pyrrolopyrrole pigments, and phthalocyanine pigments), and inorganic pigments (for example, trigonal selenium and zinc oxide). The charge generating material may be an inorganic pigment when an exposure light source having an exposure wavelength in the range of from 380 nm to 500 nm is used in the image forming apparatus, and may be a phthalocyanine pigment when an exposure light source having an exposure wavelength in the range of from 700 nm to 800 nm is used in the image forming apparatus.

In particular, the charge generating material may be a phthalocyanine pigment. When a phthalocyanine pigment is combined, in particular, with the compound having a triple bond and a hydroxy group, the dispersibility of the pigment is improved, so that excellent electrical characteristics are achieved. Examples of the phthalocyanine pigment include hydroxygallium phthalocyanine disclosed in JP-A Nos. 5-263007 and 5-279591, chlorogallium phthalocyanine disclosed in JP-A No. 5-98181, dichlorotin phthalocyanine disclosed in JP-A Nos. 5-140472 and 5-140473, and titanyl phthalocyanine disclosed in JP-A Nos. 4-189873 and 5-43813.

The hydroxygallium phthalocyanine pigment may have diffraction peaks at Bragg angles (2θ±0.2°) to CuKα characteristic X-rays of 7.5°, 9.9°, 12.5°, 16.3°, 18.6°, 25.1°, and 28.3°. The hydroxygallium phthalocyanine pigment may be a hydroxygallium phthalocyanine pigment whose half-value width of the diffraction peak at 7.5° is from 0.35° (or about 0.35°) to 1.20° (or about 1.20°). If the half-value width of the diffraction peak at 7.5° is outside the range, the particles of the hydroxygallium phthalocyanine pigment tend to reaggregate to deteriorate dispersibility; as a result, the sensitivity of the electrophotographic photoreceptor tends to deteriorate or image quality defects such as fogging tend to occur.

The binder resin may be selected from a wide range of insulating resins, or may be selected from organic photoconductive polymers such as poly-N-vinyl carbazole, polyvinyl anthracene, polyvinylpyrene, and polysilane. Examples of the binder resin include, but not limited to, insulating resins such as a polyvinyl butyral resin, a polyarylate resin (for example, a polycondensate of bisphenol A and phthalic acid), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinyl alcohol resin, and a polyvinyl pyrrolidone resin. Among these resins, polyvinyl butyral is preferable as the binder resin from the viewpoints of for example, pigment dispersibility, electrical characteristics, and environment stability. The term "insulating" means that the volume resistivity is $10^{13}$ Ωcm or more.

In an exemplary embodiment, only one binder resin is used. In another exemplary embodiment, a mixture of two or more binder resins is used.

Charge generating layer 5 may contain one or more other charge generating material than hydroxygallium phthalocyanine pigments, such as an azo pigment, a perylene pigment, or a fused aromatic pigment from the viewpoints of, for example, sensitivity adjustment and dispersibility control. Such a charge generating material that is different from a hydroxygallium phthalocyanine pigment is preferably a metal-containing or metal-free phthalocyanine, and particularly preferably a chlorogallium phthalocyanine pigment, a dichlorotin phthalocyanine pigment, or an oxytitanyl phthalocyanine pigment. The amount of such other charge generating material may be 50% by weight or less with respect to the total amount of charge generating layer 5.

Charge generating layer 5 is formed using a coating solution for forming a charge generating layer, the coating solution containing the components described above. In the coating solution for forming a charge generating layer, the mixing ratio (by weight) of a charge generating material to a binder resin may be in the range of from 10:1 to 1:10.

The components are dispersed in the coating solution for forming a charge generating layer by an ordinary method such as a ball mill dispersing method, an attritor dispersing method, or a sand mill dispersing method. During the dispersing process, conditions in which the crystal form of the pigment does not chance are necessary. During the dispersion process, the particle size is adjusted preferably to 0.5 μm or less, more preferably 0.3 μm or less, and even more preferably 0.15 μm or less.

Examples of the solvent used for the dispersing include common organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chloroberzene, and toluene. In an exemplary embodiment, only one solvent is used. In another exemplary embodiment, a mixture of two or more solvents is used.

Charge generating layer 5 is formed using the coating solution for forming a charge generating layer, by an ordinary coating method such as blade coating, wire bar coating, spray coating, dip coating, bead coating, air knife coating, or curtain coating.

The film thickness of charge generating layer 5 is preferably in the range of from 0.1 μm (or about 0.1 μm) to 5 μm (or about 5 μm), more preferably from 0.2 μm (or about 0.2 μm) to 2.0 μm (or about 2.0 μm).

Charge transporting layer 6 includes a charge transporting material and a binder resin, or a polymeric charge transporting material.

Examples of the charge transporting material include, but not limited to, electron transporting compounds, for example, quinone-containing compounds such as p-benzoquinone, chloranil, bromanil, and anthraquinone, tetracyanoquinodimethane-containing compounds, fluorenone compounds such as 2,4,7-trinitrofluorenone, xanthone-containing compounds, benzophenone-containing compounds, cyanovinyl-containing compounds, and ethylene-containing compounds; and hole-transporting compounds, for example, triarylamine-containing compounds, benzidine-containing compounds, aryl alkane-containing compounds, compounds containing an aryl-substituted ethylene, stilbene-containing compounds, anthracene-containing compounds, and hydrazone-containing compounds. In an exemplary embodiment, only one charge transporting material is used. In another exemplary embodiment, two or more charge transporting materials are used.

The charge transporting material may be a compound represented by any of the following formulae, from the viewpoint of charge mobility.

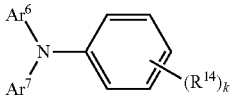

In the formula, $R^{14}$ represents a hydrogen atom or a methyl group, k represents 1 or 2. $Ar^6$ and $Ar^7$ each independently represent a substituted or unsubstituted aryl group, —$C_6H_4$—$C(R^{18})$═$C(R^{19})(R^{20})$, or —$C_6H_4$—CH═CH—CH═$C(Ar)_2$, wherein each substituent is a halogen atom, an alkyl group having 1 to 5 carbon atoms, an alkoxy group having 1 to 5 carbon atoms, or an amino group substituted by an alkyl group having 1 to 3 carbon atoms. $R^{18}$, $R^{19}$, and $R^{20}$ each independently represent a hydrogen atom, a substituted or unsubstituted alkyl group, or a substituted or unsubstituted aryl group. Ar represents a substituted or unsubstituted aryl group.

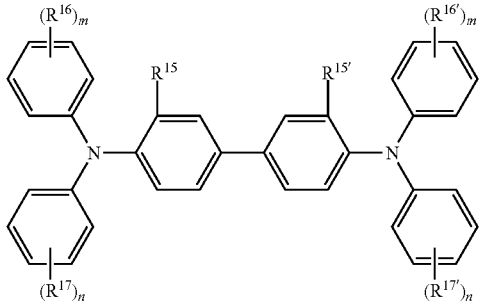

In the formula, $R^{15}$ and $R^{15'}$ each independently represent a hydrogen atom, a halogen atom, an alkyl group having 1 to 5 carbon atoms, or an alkoxy group having 1 to 5 carbon atoms. $R^{16}$, $R^{16'}$, $R^{17}$ and $R^{17'}$ each independently represent a hydrogen atom, a halogen atom, an alkyl group having 1 to 5 carbon atoms, an alkoxy croup having 1 to 5 carbon atoms, an amino group substituted by an alkyl group having 1 or 2 carbon atoms, a substituted or unsubstituted aryl group, —$C(R^{18})$═$C(R^{19})(R^{20})$ or —CH═CH—CH═$C(Ar)_2$. $R^{18}$, $R^{19}$, and $R^{20}$ each independently represent a hydrogen atom, a substituted or unsubstituted alkyl croup, or a substituted or unsubstituted aryl group. Ar represents a substituted or unsubstituted aryl group m and n each independently represent an integer in the range of from 0 to 2.

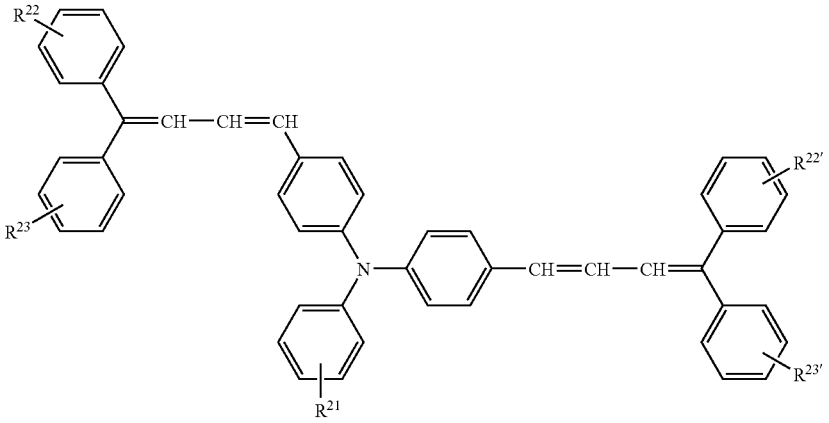

In the formula, $R^{21}$ represents a hydrogen atom, an alkyl group having 1 to 5 carbon atoms, an alkoxy group having 1 to 5 carbon atoms, a substituted or unsubstituted aryl group, or —CH=CH—CH=C(Ar)$_2$. Ar represents a substituted or unsubstituted aryl group. $R^{22}$, $R^{22'}$, $R^{23}$, and $R^{23'}$ each independently represent a hydrogen atom, a halogen atom, an alkyl group having 1 to 5 carbon atoms, an alkoxy group having 1 to 5 carbon atoms, an amino group substituted by an alkyl group having 1 or 2 carbon atoms, or a substituted or unsubstituted aryl group.

Examples of the binder resin to be used in charge transporting layer 6 include a polycarbonate resin, a polyester resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, and a styrene-alkyd resin. In an exemplary embodiment, only one binder resin is used in charge transporting layer 6. In another exemplary embodiment, a mixture of two or more binder resins is used in charge transporting layer 6. The mixing ratio (weight ratio) of charge transporting material to binder resin may be in the range of from 10:1 to 1:5.

As the polymeric charge transporting material, a known polymeric charge transporting material having charge transporting characteristics may be used, such as poly-N-vinyl carbazole or polysilane. The polyester-containing polymeric charge transporting materials disclosed in JP-A Nos. 8-176293 and 8-208820 are preferable because they have higher charge transporting characteristics in comparison with other compounds.

The polymeric charge transporting material may be used alone as the only component of charge transporting layer 6, or may be mixed with a binder resin to together form the layer.

To charge transporting layer 6, it is possible to add an antioxidant having a hindered phenol, hindered amine, thioether, or phosphite partial structure, which is effective in improving image quality and the electric potential stability in varying environment.

Examples of the antioxidant include following compounds: hindered phenol-containing antioxidants such as "SUMILIZER BHT-R", "SUMILIZER MDP-S", "SUMILIZER BBM-S", "SUMILIZER WX-R", "SUMILIZER NW", "SUMILIZER BP-76", "SUMILIZER BP-101", "SUMILIZER GA-80", "SUMILIZER GM", and "SUMILIZER CS" manufactured by Sumitomo Chemical Co., Ltd., "IRGANOX 1010", "IRGANOX 1035", "IRGANOX 1076", "IRGANOX 1098", "IRGANOX 1135", "IRGANOX 1141", "—IRGANOX 1222", "IRGANOX 1330", "IRGANOX 1425WL", "IRGANOX 1520L", "IRGANOX 245", "IRGANOX 259", "IRGANOX 3114", "IRGANOX 3790", "IRGANOX 5057", and "IRGANOX 565" manufactured by Ciba Specialty Chemicals, Inc., "ADEKA STAB AO-20", "ADEKA STAB AO-30", "ADEKA STAB AO-40", "ADEKA STAB AO-50", "ADEKA STAB AO-60", "ADEKA STAB AO-70", "ADEKA STAB AO-80", and "ADEKA STAB AO-330" manufactured by Asahi Denka Corporation; hindered amine-containing antioxidants such as "SANOL LS2626", "SANOL LS765", "SANOL LS770", and "SANOL LS744" manufactured by Sankyo Lifetech Co., Ltd., "TINUVIN 144" and "TINUVIN 622LD" manufactured by Ciba Specialty Chemicals, Inc., "MARK LA57", "MARK LA67", "MARK LA62", "MARK LA68", and "MARK LA63" manufactured by Asahi Denka Corporation, "SUMILIZER TPS" manufactured by Sumitomo Chemical Co., Ltd.; thioether-containing antioxidants such as "SUMILIZER TP-D" manufactured by Sumitomo Chemical Co., Ltd.; and phosphite-containing antioxidants such as "MARK 2112", "MARK PEP-8", "MARK PEP-24G", "MARK PEP-36", "MARK 329K", and "MARK HP-10"manufactured by Asahi Denka Corporation. The antioxidant may be a hindered phenol-containing antioxidant or a hindered amine-containing antioxidant. These antioxidants may be modified with a substituent (e.g., an alkoxysilyl group) which can undergo a cross-linking reaction with a material which forms a cross-linked film.

Charge transporting layer 6 may contain at least one electron acceptor for the purposes of, for example, improvement of sensitivity, reduction of residual potential, and reduction of fatigue during repeated use.

Examples of the electron acceptor include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among these electron acceptors, fluorenone-containing and quinone-containing electron acceptors, and benzene derivatives having an electron-withdrawing substituent such as Cl, CN, or $NO_2$ are preferable.

Charge transporting layer 6 is formed using the coating solution for forming a charge transporting layer containing the above-described components.

Examples of the solvent for the coating solution for forming a charge transporting layer include ordinary organic solvents, for example, aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. In an exemplary embodiment, only one solvent is used in the coating solution. In another exemplary embodiment, a mixture of two or more solvents is used in the coating solution.

The coating solution for forming a charge transporting layer may be applied by an ordinary coating method such as blade coating, wire bar coating, spray coating, dip coating, bead coating, air knife coating, or curtain coating.

The film thickness of charge transporting layer 6 is preferably in the range of from 5 μm to 50 μm, more preferably from 10 μm to 30 μm.

The electrophotographic photoreceptor as described above in accordance with the exemplary embodiment of the invention is a function-separation type electrophotographic photoreceptor. However, the electrophotographic photoreceptor may alternatively be a single-layer type electrophotographic photoreceptor. The photosensitive layer of a single-layer type includes, for example, at least a compound having a triple bond and a hydroxy group, a charge generating material, and, as necessary, a binder resin. The compound having a triple bond and a hydroxy group is may be selected from those usable in charge generating layer 5, the charge generating material may be selected from those usable in charge generating layer 5 in the function-separation type photosensitive layer, and the binder resin may be selected from those usable in charge generating layer 5 and charge transporting layer 6 in the function-separation type photosensitive layer. The content of the charge generating material in single-layer type photosensitive layer 8 is preferably in the range of from 10% by weight to 85% by weight, more preferably from 20% by weight to 50% by weight with respect to the total solid content in single-layer type photosensitive layer 8. Single-layer type photosensitive layer 8 may contain a charge transporting material and a polymeric charge transporting material for the purposes of, for example, improving photoelectronic characteristics. The amount of such additives may be in the range of from 5% by weight to 50% by weight with respect to the total solid content in single-layer type photosensitive layer 8. The solvent and coating method used for coating may be similar to those usable for the application of the above layers. The film thickness of single-layer type photosensitive layer 8 is preferably in the range of from about 5 μm to about 50 μm, more preferably from 10 μm to 40 μm.

(Image Forming Apparatus and Process Cartridge)

Figure 2:
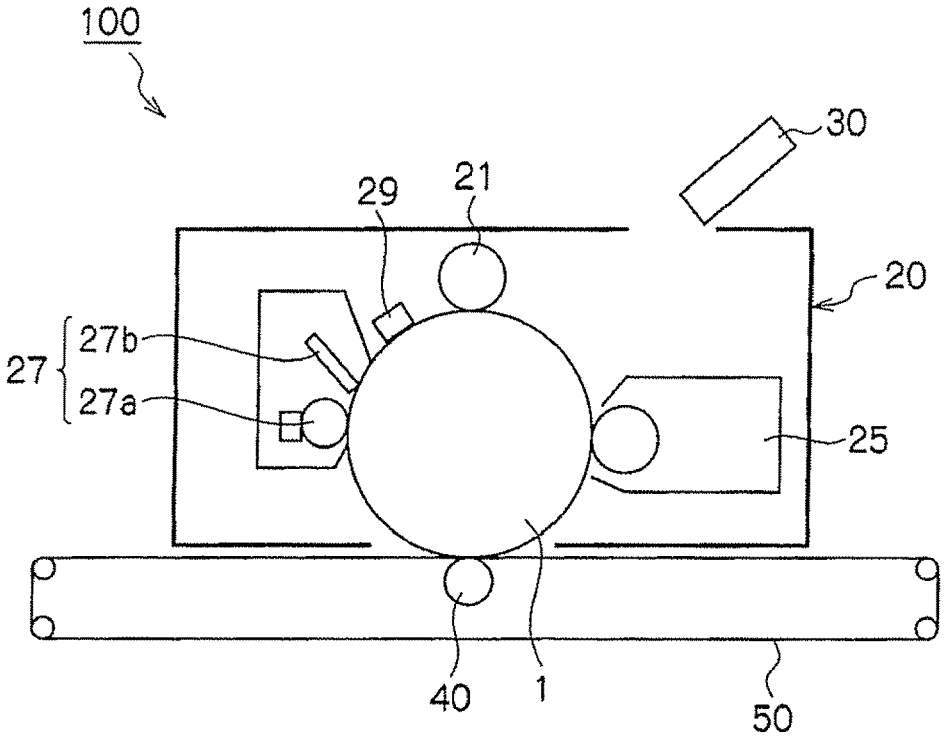
FIG. 2 is a schematic view showing an electrophotographic photoreceptor in accordance with an exemplary embodiment of the invention.

FIG. 2 is a schematic view showing an image forming apparatus in accordance with an exemplary embodiment of the invention. Image forming apparatus 100 shown in FIG. 2 includes, in a main body (not shown) of the image forming apparatus, process cartridge 20 including above-mentioned electrophotographic photoreceptor 1, exposure device 30, transfer device 40, and intermediate transfer body 50. In image forming apparatus 100, exposure device 30 is arranged in a position from which exposure device 30 can expose electrophotographic photoreceptor 1 through the opening of process cartridge 20, transfer device 40 is arranged in a position that opposes electrophotographic photoreceptor 1 with intermediate transfer body 50 located therebetween, and intermediate transfer body 50 is arranged such that at least a part of intermediate transfer body 50 contacts electrophotographic photoreceptor 1.

Process cartridge 20 includes electrophotographic photoreceptor 1, charging device 21, developing device 25, cleaning device 27, and fibrous member (flat brush) 29, all of which are integrated in a case. The case for accommodating the integrated components has an opening for exposure.

Charging device 21 charges the electrophotographic photoreceptor 1 in a contact manner. Developing device 25 forms a toner image by developing the electrostatic latent image on electrophotographic photoreceptor 1.

The toner used in developing device 25 is described below. The toner preferably has an average shape factor ($ML^2/A\times\pi/4\times100$, wherein ML represents the maximum length of a toner particle, A represents the projected area of the toner particle, and π represents the circular constant) in the range of from 100 to 150, more preferably from 100 to 140. The volume average particle diameter of the toner is preferably in the range of from 2 μm to 12 μm, more preferably from 3 μm to 12 μm, and even more preferably from 3 μm to 9 μm. The toner having an average shape factor and a volume average particle diameter within the above ranges offers higher developability, higher transferability, and an image with higher quality, in comparison with other toners.

The toner is not particularly limited by its production method as long as the resultant toner has an average shape factor and a volume average particle diameter within the ranges. The toner may be produced by, for example: a kneading-pulverizing method in which a binder resin, a colorant, a releasing agent, and, optionally, other additives such as a charge control agent are kneaded, pulverized, and classified; a method of changing the shape of the particles obtained by the kneading-pulverizing method by mechanical impact or heat energy; an emulsion-polymerization aggregation method in which a polymerizable monomer of a binder resin is emulsion-polymerized, and the resultant dispersion is mixed with a dispersion containing a colorant, a releasing agent, and optionally other additives such as a charge control agent, and then the mixture is allowed to aggregated and is fused under heating to produce toner particles; a suspension polymerization method in which a solution containing a polymerizable monomer for making a binder resin, a colorant, a releasing agent, and, optionally, other additives such as a charge control agent is suspended in an aqueous solvent and is allowed to polymerize; and a dissolution suspension method in which a solution containing a binder resin, a colorant, a releasing agent, and, optionally, other additives such as a charge control agent is suspended in an aqueous solvent, and is allowed to form particles.

Known production methods may be used, such as a production method in which aggregated particles are attached to the toner obtained by the above-described method as the core, and are allowed to fuse under heating to make a core-shell structure. The method for producing the toner is preferably a suspension polymerization method, an emulsion polymerization aggregation method, or a dissolution suspension method, in which the production is conducted in an aqueous solvent from the viewpoints of shape control and particle size distribution control, and is particularly preferably an emulsion polymerization aggregation method.

Toner mother particles include a binder resin, a colorant, and a releasing agent, and, optionally, silica and a charge control agent.

Examples of the binder resin used in the toner mother particles include homopolymers and copolymers of: styrenes such as styrene and chlorostyrene; monoolefins such as ethylene, propylene, butylene, and isoprene; vinyl esters such as vinyl acetate, vinyl propionate, vinyl benzoate, vinyl butyrate; α-methylene aliphatic monocarboxylic esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; vinyl ketones such as vinyl methyl ketone, vinyl hexyl ketone, and vinyl isopropenyl ketone; and polyester resins prepared by copolymerization of dicarboxylic acids and diols.

Particularly typical examples of the binder resin include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, and a polyester resin. Other examples include polyurethane, an epoxy resin, a silicone resin, polyamide, modified rosin, and paraffin wax.

Typical examples of the colorant include magnetic powder such as magnetite and ferrite, carbon black, aniline blue, chalcoil blue, chromium yellow, ultramarine blue, Du Pont Oil Red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, and C.I. Pigment Blue 15:3.

Typical examples of the releasing agent include low molecular weight polyethylene, low molecular weight polypropylene, Fischer-Tropsch Wax, Montan wax, carnauba wax, rice wax, and candelilla wax.

The charge control agent may be a known charge control agent, such as an azo metal complex compound, a salicylate metal complex compound, or a charge control agent of resin type containing a polar group. When the toner is produced by a wet process, the material is preferably poorly soluble in water from the viewpoints of control of ionic strength and reduction of water contamination. The toner may be either a magnetic toner containing a magnetic material or a non-magnetic toner containing no magnetic material.

The toner used in developing device 25 is produced by mixing the toner mother particles and the external additives with, for example, a Henschel mixer or a V blender. When the toner mother particles are produced by a wet process, the external additives may be added by a wet process.

Lubricant particles may be added to the toner used in developing device 25. Examples of the lubricant particles include: solid lubricants such as graphite, molybdenum disulfide, talc, fatty acids, and fatty acid metal salts; low molecular weight polyolefins such as polypropylene, polyethylene, and polybutene; silicones that shows a softening point upon heating; aliphatic amides such as oleic amide, erucic amide, ricinoleic amide, and stearic amide; vegetable wax such as carnauba wax, rice wax, candelilla wax, Japan wax, and jojoba oil; animal wax such as yellow beeswax; mineral or petroleum wax such as Montan wax, ozokerite, ceresin, paraffin wax, microcrystalline wax, Fischer-Tropsch wax; and modified derivatives thereof. In an exemplary embodiment, only one lubricant is used. In another exemplary embodiment, a combination of two or more lubricants is used. The volume average particle diameter of the lubricant particles may be in the range of from 0.1 μm to 10 μm. Those having the above-described chemical structure may be pulverized to uniformize the particle diameter. The amount of the particles to be added to the toner is preferably in the range of from 0.05% by weight to 2.0% by weight, more preferably from 0.1% by weight to 1.5% by weight.

Inorganic particles, organic particles, composite particles prepared by attaching inorganic particles to organic particles, or the like may be added to the toner to be used in developing device 25, for the purpose of, for example, removal of adherents or deteriorated matter present on the surface of the electrophotographic photoreceptor.

Examples of the inorganic particles include various inorganic oxides, nitrides, and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride.

These inorganic particles may be treated with a titanium coupling agent or a silane coupling agent. Examples of the titanium coupling agent include as tetrabutyl titanate, tetraoctyl titanate, isopropyltriisostearoyl titanate, isopropyltridecylbenzenesulfonyl titanate, and bis(dioctylpyrophosphate) oxyacetate titanate. Examples of a silane coupling agent include γ-(2-aminoethyl)aminoproinyltrimethoxysilane, γ-(2-aminoethyl)aminopropylmethyldimethoxysilane, γ-methacryloxypropyltrimethoxysilane, N-β-(N-vinylbenzylaminoethyl)γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, and p-methylphenyltrimethoxysilane. These inorganic particles may be subjected to a hydrophobicity-imparting, treatment with a higher fatty acid metal salt such as silicone oil, aluminum stearate, zinc stearate, or calcium stearate.

Examples of the organic particles include styrene resin particles, styrene acrylic resin particles, polyester resin particles, and urethane resin particles.

The particles have a volume average particle diameter of preferably in the range of from 5 nm to 1,000 nm, more preferably from 5 nm to 800 nm, and even more preferably from 5 nm to 700 nm. When the volume average particle diameter is less than the lower limit, the particles tend to have an insufficient polishing ability. When the volume average particle diameter is more than the upper limit, the particles tend to scratch the surface of the electrophotographic photoreceptor. The total amount of the particles and the lubricant particles may be 0.6% by weight or more.

Other examples of inorganic oxides that may be added to the toner include inorganic oxides having a small primary particle diameter of 40 nm or less, which may be added to control powder flowability and charge. When such an inorganic oxide with a small diameter is used, it is possible to further add another inorganic oxide with a larger diameter than the above-mentioned inorganic oxide with a small diameter, for the purpose of reducing adhesion force and controlling charge. These inorganic oxide particles may be known ones. A combination of silica and titanium oxide is preferable for accurate charge control. The dispersibility of the inorganic particles with a small diameter may be improved by surface treatment, whereby the effect of enhancing powder flowability is strengthened. It is also preferable, from the viewpoint of removing corona products, to add a carbonate such as calcium carbonate or magnesium carbonate and/or an inorganic mineral such as hydrotalcite.

An electrophotographic color toner may be used in the form of a mixture with a carrier. Examples of the carrier include iron powder, glass beads, ferrite powder, and nickel powder, which may be coated with a resin. The mixing proportion of toner to carrier may be arbitrarily determined.

Cleaning device 27 includes fibrous member (in a roll shape) 27*a* and cleaning blade (blade member) 27*b*.

The cleaning device 27 includes fibrous member 27*a* and cleaning blade 27*b*. As an alternative, the cleaning device may include only one of fibrous member 27*a* and cleaning blade 27*b*. Fibrous member 27*a* may be in a roll shape, or in a toothbrush shape (a flat brush shape). Fibrous member 27*a* may be fixed to, or rotatably supported by, the main body of the cleaning device, or may be supported so as to allow oscillation in the axial direction of the photoreceptor. Fibrous member 27*a* may be, for example, in a cloth form with ultrafine fibers of, for example, polyester, nylon, acryl, or TORAYSEE (manufactured by Toray Industries, Inc.), or in a brush form with resin fibers such as nylon, acryl, polyolefin, or polyester embedded in the form or a base material or a carpet. Fibrous member 27*a* as described above may contain a conductive powder or an ion conductive agent, which imparts electric conductivity to fibrous member 27*a*, or, in fibrous member 27*a*, each fiber may have a conductive layer provided inside or outside the fiber. When electric conductivity is imparted to fibrous member 27*a*, the electric resistance of each fiber itself may be in the range of from $10^2$ Ω to $10^9$ Ω. The fiber thickness of fibrous member 27*a* is preferably 30 d (denier) or less, more preferably 20 d or less, and the fiber density is preferably 20,000/inch$^2$ or more, more preferably 30,000/inch$^2$ or more.

Cleaning device 27 is required to remove adherents (for example, discharge products) from the photoreceptor surface with a cleaning blade and/or a cleaning brush. In order to achieve the purpose over a long period and stabilize the function of the cleaning member, it is preferable to supply a lubricant substance (lubricant component) such as a metallic soap, a higher alcohol, a wax, or a silicone oil to the cleaning member.

For example, when fibrous member 27*a* is in a roll shape, the member may be brought into contact with a lubricant substance such as a metallic soap or a wax, thereby supplying the lubricant component to the surface of the electrophotographic photoreceptor Cleaning blade 27*b* may be an ordinary rubber blade. When a rubber blade is used as cleaning blade 27*b*, the supply of a lubricant component to the surface of the electrophotographic photoreceptor is particularly effective in suppressing chipping or wear of the blade.

Process cartridge 20 described above is attachable to and detachable from the main body of the image forming apparatus, and, together with the main body of the image forming apparatus, constitutes the image forming apparatus.

Exposure device 30 may be an exposure device that can expose charged electrophotographic photoreceptor 1 to light so as to form an electrostatic latent image. The light source of the exposure device 30 may be a multi-beam surface emitting laser.

Transfer device 40 transfers a toner image on electrophotographic photoreceptor 1 to the medium to which the toner image is to be transferred (intermediate transfer body 50), and may be, for example, a common transfer device in a roll shape.

The intermediate transfer body 50 may be a belt-shaped member (intermediate transfer belt) made of, for example, a polyimide, polyamide imide, polycarbonate, polyarylate, polyester, or rubber to which semiconductivity is imparted. Intermediate transfer body 50 may be, other than a belt shape, in a drum shape. There are direct-transfer image forming apparatuses that do not have an intermediate transfer body. The electrophotographic photoreceptor in accordance with the exemplary embodiment is also suitable for such image forming apparatuses.

The medium to which the toner image is to be transferred (receiving medium) is not particularly limited as long as a toner image on electrophotographic photoreceptor 1 is transferred to the receiving member. The receiving medium is, for example, paper when a toner image is directly transferred from electrophotographic photoreceptor 1 to the paper. As another example, when intermediate transfer member 50 is used, the receiving medium is the intermediate transfer body.

Figure 3:
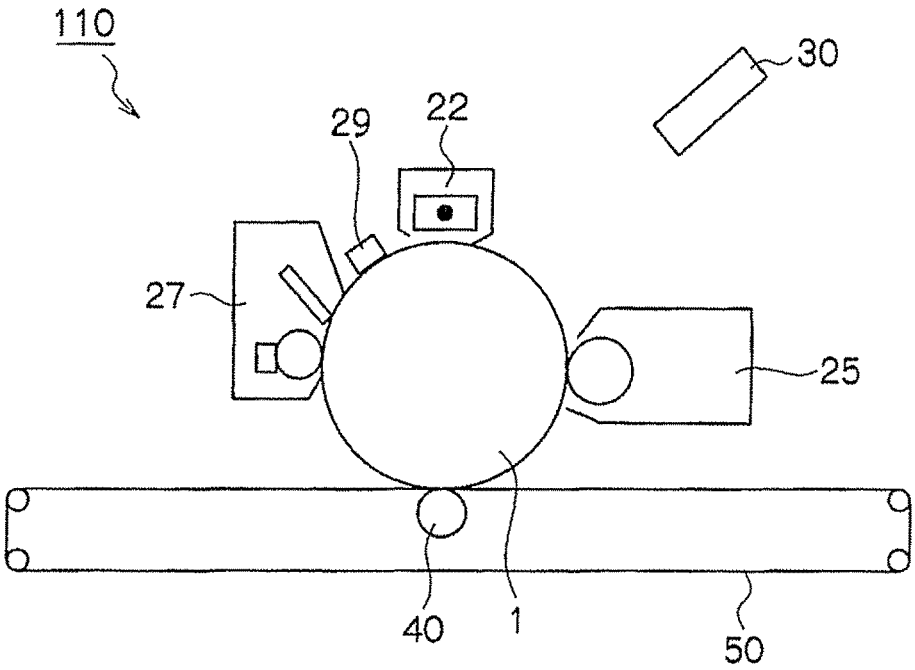
FIG. 3 is a schematic view showing an electrophotographic photoreceptor in accordance with another exemplary embodiment of the invention.

FIG. 3 is a schematic view showing an image forming apparatus in accordance with another exemplary embodiment of the invention. Image forming apparatus 110 shown in FIG. 3 includes electrophotographic photoreceptor 1 fixed to the main body of the image forming apparatus, charging device 22, developing device 25, and cleaning device 27 which are independently housed in a charging cartridge, a developing cartridge, and a cleaning cartridge, respectively. Charging device 22 includes a charging device that performs charging by a corona discharge system.

In image forming apparatus 110, electrophotographic photoreceptor 1 is isolated from the other devices, and charging device 22, developing device 25, and cleaning device 27 are not fixed by screws, caulking, adhesion, or welding to the main body of the image forming apparatus. Charging device 22, developing device 25, and cleaning device 27 can be attached to and detached from the main body by pulling and pushing.

In some cases, it is not required that the photoreceptor be housed in a cartridge since the electrophotographic photoreceptor in accordance with the exemplary embodiment has excellent durability. Accordingly, when charging device 22, developing device 25, or cleaning device 27 is not fixed to the main body by screws, caulking, adhesion, or welding, and is detachable from and attachable to the main body by pulling and pushing, the cost for the members per print is reduced. It is also possible to provide an attachable and detachable cartridge in which two or more of these devices are integrated, whereby the cost for the members per print is further reduced.

Image forming apparatus 110 has the same structure as image forming apparatus 100 except that charging device 22, developing device 25, and cleaning device 27 are each housed in a cartridge. Therefore, the reference characters not mentioned in the explanation for FIG. 3 represent the same elements as in FIG.

Figure 4:
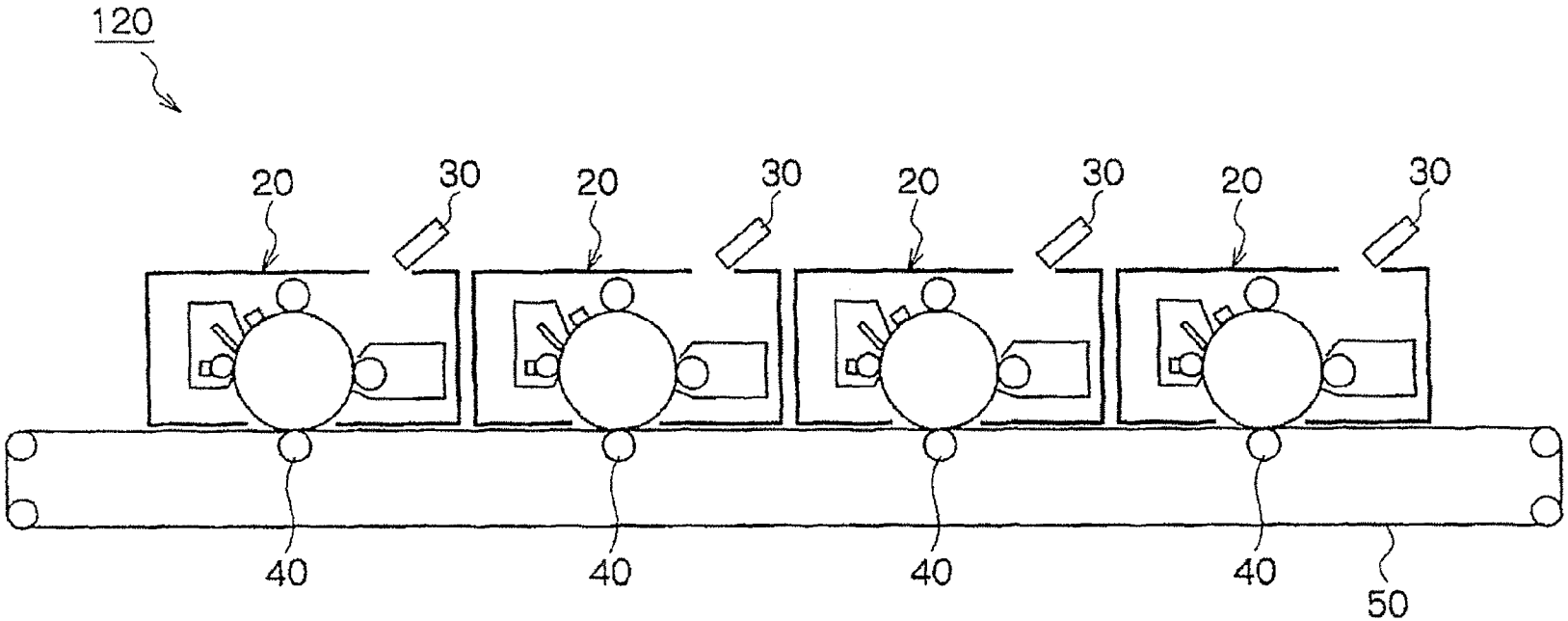
FIG. 4 is a schematic view showing an electrophotographic photoreceptor in accordance with another exemplary embodiment of the invention.

FIG. 4 is a schematic view showing an image forming apparatus in accordance with another exemplary embodiment. Image forming apparatus 120 is a tandem-system full color image forming apparatus including four process cartridges 20. In image forming apparatus 120, four process cartridges 20 are arranged in parallel on intermediate transfer body 50, wherein one electrophotographic photoreceptor is used for each color. Image forming apparatus 120 has the same structure as image forming apparatus 100 except that it uses a tandem system. Therefore, the reference characters not mentioned in the explanation for FIG. 4 represent the same elements as in FIG. 2.

In tandem-system image forming apparatus 120, the electrical characteristics of the respective electrophotographic photoreceptors tend to become varied due to the difference in wear amounts of the respective electrophotographic photoreceptors which reflects the use ratio of the respective colors. During this process, the toner development characteristics tend to gradually change from the initial state; as a result, there is a tendency that the color of printed images change and stable formation of images becomes impossible. There is a trend to use an electrophotographic photoreceptor with a small diameter in order to downsize the image forming apparatus. When a photoreceptor having a diameter of 30 mm or less is used, however, such a tendency is apparent. When the electrophotographic photoreceptor has the structure of the electrophotographic photoreceptor in accordance with the exemplary embodiment of the invention, the wear of the photoreceptor surface is suppressed even when the diameter of the photoreceptor is 30 mmϕ or less. Accordingly, the electrophotographic photoreceptor in accordance with the exemplary embodiment of the invention is particularly effective in tandem-system image forming apparatuses.

Figure 5:
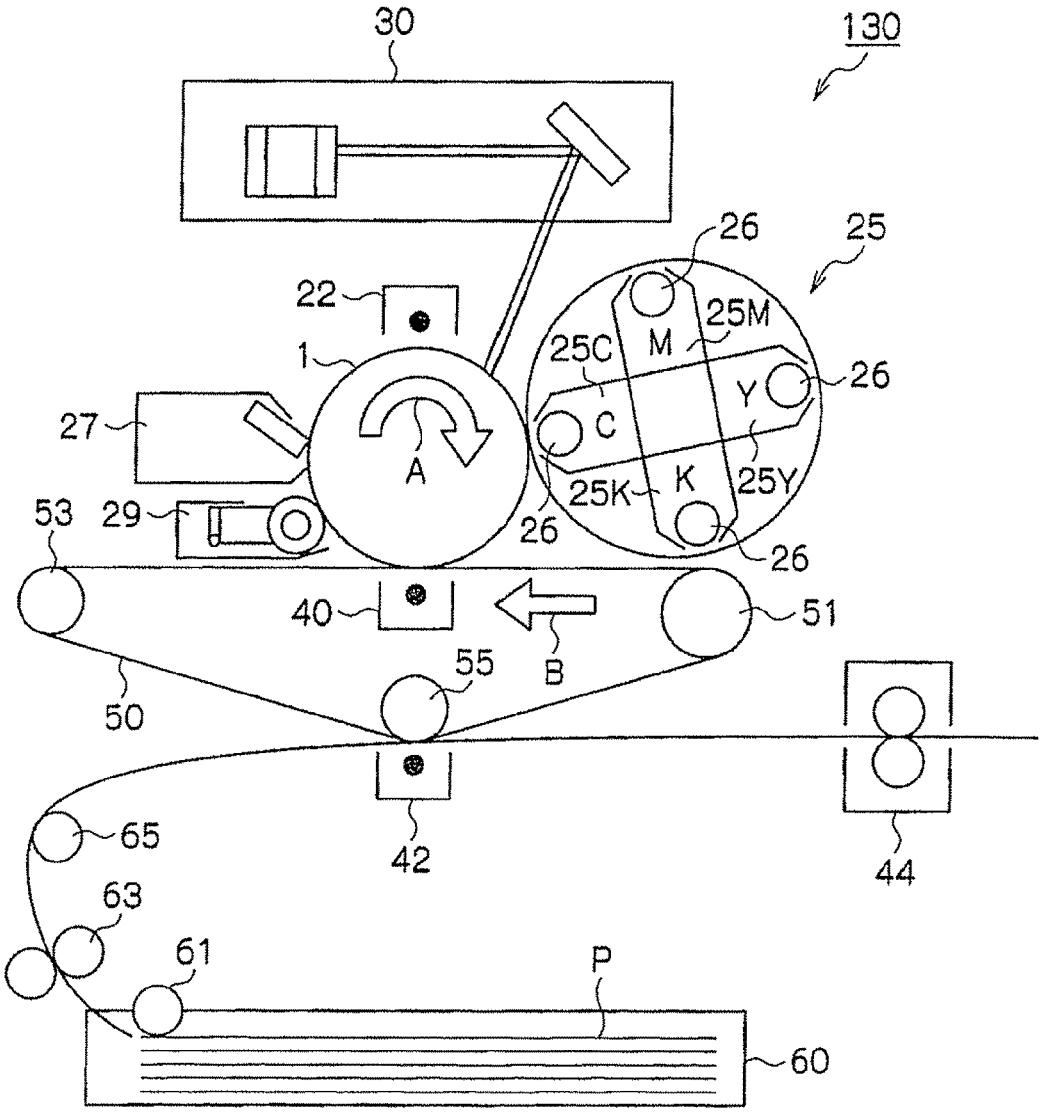
FIG. 5 is a schematic view showing an electrophotographic photoreceptor in accordance with another exemplary embodiment of the invention.

FIG. 5 is a schematic view showing an image forming apparatus in accordance with another exemplary embodiment of the invention. Image forming apparatus 130 shown in FIG. 5 is a so-called four-cycle system image forming apparatus, in which plural color toner images are formed using one electrophotographic photoreceptor. Image forming apparatus 130 includes photoreceptor drum 1 which is rotated by a driving device (not shown) in the direction indicated by arrow A at a predetermined rotation velocity and charging device 22 which is provided above photoreceptor drum 1 and which charges the circumference surface of photoreceptor drum 1.

In addition, exposure device 30 is provided above charging device 22. Exposure device 30 has a surface emitting laser array as the exposure light source. Exposure device 30 modulates plural laser beams emitted from the light source in accordance with the image to be formed, and deflects the beams in the main scanning direction so that the circumference surface of photoreceptor drum 1 is scanned, with the laser beams, in parallel with the axis of photoreceptor drum 1. As a result of this, an electrostatic latent image is formed on the circumference surface of charged photoreceptor drum 1.

Developing device 25 is arranged at a side of photoreceptor drum 1. Developing device 25 includes a rotatably-disposed roller-shaped housing. Four accommodation parts are provided inside the housing, and development units 25Y, 25M, 25C, 25K are disposed in the respective accommodation parts. The development units 25Y, 25M, 25C, 25K each include a development roller 26, and store inside thereof yellow (Y), magenta (M), cyan (C), and black (K) color toners, respectively.

The formation of a full color image in image forming apparatus 130 is conducted through formation of four color images by photoreceptor drum 1. More specifically, during the four image formation cycles by photoreceptor drum 1, the following cycle is repeated while the image data used for the modulation of the laser beams is changed every time photoreceptor drum 1 forms a color image. In each cycle, charging device 22 charges the circumference surface of photoreceptor drum 1, and exposure device 30 scans the circumference surface of photoreceptor drum 1 with laser beams modulated in accordance with any one of the Y image data, the M image data, the C image data, and the K image data representing the color image to be formed. When development roller 26 of either of development unit 25Y, 25M, 25C, or 25K faces the circumference surface of photoreceptor drum 1, developing device 25 activates the development unit facing the circumference surface, thereby developing an electrostatic latent image formed on the circumference surface of photoreceptor drum 1 into a specific color and forming a toner image in the specific color on the circumference surface of photoreceptor drum 1. This color toner image formation cycle is repeated while the housing is rotated such that the developing device used for developing an electrostatic latent image is changed every time photoreceptor drum 1 forms an image. In this way, Y, M, C, and K toner images are successively formed on the circumference surface of photoreceptor drum 1.

Endless intermediate transfer belt 50 is provided below photoreceptor drum 1. Intermediate transfer belt 50 is wrapped around rollers 51, 53, and 55, and is arranged in such a manner that its circumference surface is in contact with the circumference surface of photoreceptor drum 1. Rollers 51, 53, and 55 are rotated by the driving force transferred from a motor (not shown), so that intermediate transfer belt 50 is rotated in the direction indicated by the arrow B in FIG. 5.

Transfer device (transfer unit) 40 is arranged at the opposite side of intermediate transfer belt 50 to photoreceptor drum 1, with intermediate transfer belt 50 sandwiched between transfer device 40 and photoreceptor drum 1. Y, M, C, and K toner images successively formed on the circumference surface of photoreceptor drum 1 are transferred one by one to the image formation surface of intermediate transfer belt 50 by transfer device 40, and finally, all of the Y, M, C, and K toner images are stacked on intermediate transfer belt 50.

Lubricant supplying device 29 and cleaning device 27 are arranged at the circumference surface of photoreceptor drum 1, and are located at the opposite side of photoreceptor drum 1 to the developing device 25 side. When a toner image formed on the circumference surface of photoreceptor drum 1 is transferred to intermediate transfer belt 50, a lubricant is supplied to the circumference surface of photoreceptor drum 1 by lubricant supplying device 29, and the areas on the circumference surface holding the transferred toner image are cleaned by cleaning device 27.

Paper feeding device 60 is disposed below intermediate transfer belt 50, and paper P as the recording material is accommodated, in the state of a stack of plural sheets, in feeding device 60. Pulling roller 61 is arranged at the obliquely upper left of paper feeding device 60, and a pair of rollers 63 and roller 65 are arranged in this order at the downstream side of roller 61 with respect to the feeding direction of paper P. The recording paper located on the top of the stack is taken out of paper feeding device 60 by the rotation of pulling roller 61, and transferred by the pair of rollers 63 and roller 65.

Transfer device 42 is arranged at the opposite side of intermediate transfer belt 50 to roller 55 side, with intermediate transfer belt 50 sandwiched between transfer device 42 and roller 55. Paper P transferred by the pair of rollers 63 and roller 65 is conveyed to between intermediate transfer belt 50 and transfer device 42, and the toner image formed on the image formation surface of intermediate transfer belt 50 is transferred by transfer device 42. Fixing device 44 including a pair of fixing rollers is arranged at the downstream side of transfer device 42 with respect to the transfer direction of paper P. Paper P, holding the transferred toner image, undergoes a process in which the transferred toner image is melted and fixed by fixing device 44, and then is discharged from image forming apparatus 130 and placed on a paper discharge tray (not shown).

EXAMPLES

The present invention is further illustrated with reference to the following examples, but the invention is not limited to the examples.

Example 1

—Production of Photoreceptor 1—

A cylindrical aluminum base material is prepared as a conductive support.

100 parts by weight of zinc oxide (trade name: SMZ-017N, manufactured by Tayca Corporation) and 500 parts by weight of toluene are mixed under stirring. To the resultant mixture, 2 parts by weight of a silane coupling agent (trade name: A 1100, manufactured by Nippon Unicar Co., Ltd.) is added and stirred for 5 hours. Thereafter, toluene is remove by evaporation under reduced pressure, and the remainder is baked at 120° C. for 2 hours. The obtained surface-treated zinc oxide is analyzed with fluorescent X-ray; and it is found that the ratio of Si element intensity to zinc element strength is $1.8\times10^{-4}$.

35 parts by weight of the surface-treated zinc oxide is mixed with 15 parts by weight of a curing agent (blocked isocyanate, trade name: SUMIDUR 3175, manufactured by Sumitomo Bayer Urethane Co., Ltd.), 6 parts by weight of a butyral resin (trade name: S-LEC BM-1, manufactured by Sekisui Chemical Co., Ltd.), and 44 parts by weight of methyl ethyl ketone, and the resultant mixture is dispersed for 2 hours in a sand mill with glass beads having a diameter of 1 mm, whereby a dispersion liquid is obtained. To the obtained dispersion liquid, 0.005 part by weight of dioctyltin dilaurate as a catalyst and 17 parts by weight of silicone particles (trade name. TOSPAL 130, manufactured by GE Toshiba Silicone Co., Ltd.) are added to make a coating solution for forming an undercoat layer.

The coating solution is applied onto the aluminum base material by dip coating, and the coating is cured by drying at 160° C. for 100 minutes to form a undercoat layer having a thickness of 20 μm. The surface roughness of the undercoat layer (ten-point average roughness (Rz) as defined in JIS B0601 (1994)) is measured with a surface roughness analyzer (trade name: SURFCOM 570A, manufacture by Tokyo Seimitsu Co., Ltd.) at a measurement distance of 2.5 mm and a scanning speed of 0.3 mm/sec. the ten-point average roughness (Rz) is 0.24 μm.

Subsequently, 1 part by weight of titanylphthalocyanine having a strong diffraction peak at a Bragg angle (2θ±0.2°) of 27.2° in an X ray diffraction spectrum is mixed with 1 part by weight of polyvinyl butyral (trade name: S-LEC BX-S, manufactured by Sekisui Chemical Co., Ltd.), 100 parts by weight of n-butyl acetate, and 0.01 part by weight of 2,4,7,9-tetramethyl-5-decyne-4,7-diol, and the mixture is treated with glass beads in a paint shaker for 1 hour so as to form a dispersion. As a result, a coating solution for forming a charge generating layer is obtained. Aggregation of the charge generating material is not detected in the obtained coating solution. The coating solution is applied to the aluminum base material by dip coating, and the coating is dried by heating at 100° C. for 10 minutes to form a charge generating layer having a film thickness of 0.15 μm.

Subsequently, 2 parts by weight of the benzidine compound represented by the following formula and 2.5 parts by weight of the polymer compound having the structural unit expressed by the following formula (viscosity average molecular weight: 50,000) are dissolved in 25 parts by weight of chlorobenzene to make a coating solution for forming a charge transporting layer.

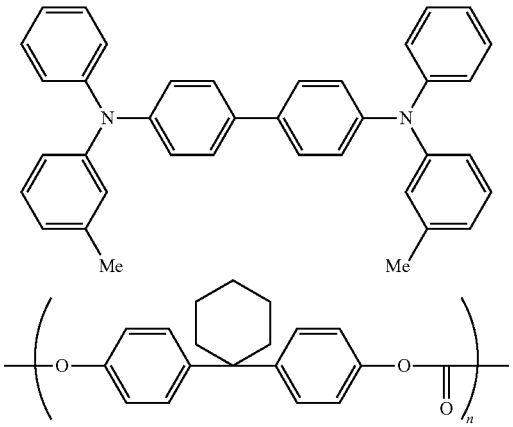

The obtained coating solution is applied to the charge generating layer by dip coating, and the coating is heated at 130° C. for 40 minutes to form a charge transporting layer having a thickness of 25 μm, whereby photoreceptor 1 is obtained.

Evaluation Tests on Characteristics of Electrophotographic Photoreceptor

An image forming apparatus is made using photoreceptor 1. The components other than the electrophotographic photoreceptor are the same as those used in DocuCentre color 400 CP manufactured by Fuji Xerox Co., Ltd.

Subsequently, image formation test is conducted by forming a halftone image having an image density of 20% on 1000 sheets at high temperature and high humidity (27° C., 80% RH), and then the sheets are subjected to the image quality evaluation tests (1) and (2).

Following the image quality evaluation tests, another image formation test is conducted by forming a halftone image having an image density of 20% on 1000 sheets at low temperature and low humidity (10° C., 25% RH), and then the sheets are subjected to the image quality evaluation tests (1) and (2). The obtained results are shown in Table 1.

J paper (A3 size) manufactured by Fuji Xerox Office Supply Co., Ltd. is used for the image formation tests.

Image Evaluation Test (1)

The image quality evaluation test (1) is conducted by printing an image containing thin lines containing a one-dot line and a two-dot line and a halftone image having an image density of 20%, and then the image quality is evaluated on the basis of the following criteria:

A: abnormality is observable in neither of thin lines nor halftone image;

B: Thinning of the 2-dot line by 50% or less is observable (practically acceptable);

C: slight unevenness is observable in the halftone image (practically acceptable);

D: Thinning of the 2-dot line by more than 50% is observable, and breaking of 1-dot line is observable (unacceptable in the case of color printing machines with strict specifications); and E: unevenness is observable in the halftone image (unacceptable in the case of color printing machines with strict specifications).

Image Evaluation Test (2)

The image quality evaluation test (2) is conducted by printing under no irradiation for discharge, and then the image quality is evaluated on the basis of the following criteria:

A: no abnormality is observable;

B: slight ghosts (residual image phenomenon caused by remaining history of a previous image) are observable (practically acceptable); and C: ghosts are observable (unacceptable in the case of color printing machines with strict specifications).

Figure 6C:
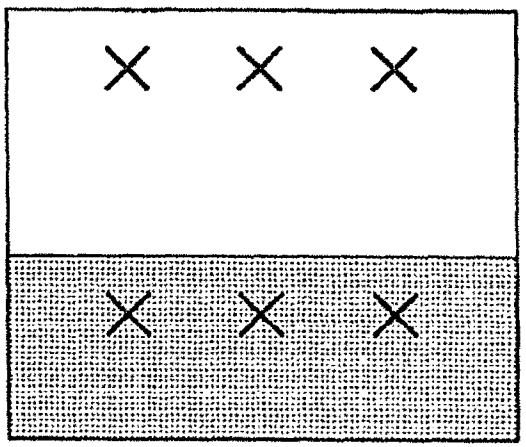
FIGS. 6A to 6C are explanatory drawings showing the criteria for evaluating the generation of ghosts in Examples.
Figure 6B:
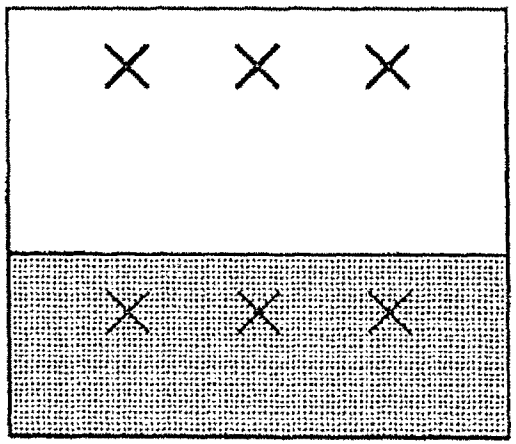
Figure 6A:
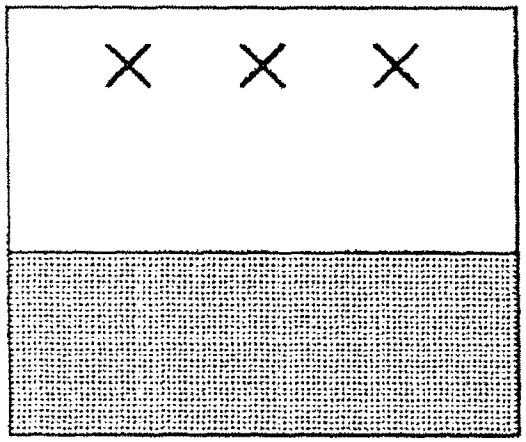

Ghosts are evaluated as follows: an image containing a 100% output image pattern and "X" characters are output as an image, and the degree of the appearance of the "X"characters in the 100% output image area is evaluated on the basis of the above-described criteria, as shown in FIGS. 6A to 6C.

Evaluation of Charging Potential Variation

Variation of the charging potential is evaluated as follows: the charging potential A at an exposure position before the image formation test at high temperature and high humidity, and the charging potential B at the exposure position after the image formation test at low temperature and low humidity are measured with a surface potential meter, and the absolute value of the variation in the charging potential (=|charging potential B−charging potential A|(V)) is evaluated on basis of the following criteria:

A: absolute value of variation in charging potential is less than 10 V;

B: absolute value of variation in charging potential is 10 V or more but less than 20 V; and C: absolute value of variation in charging potential is 20 V or more.

An initial setting is made such that the charging potential before the image formation test is −720 V, and the image formation test is performed without changing the condition.

Example 2

—Production of Photoreceptor 2—

The steps leading up to the formation of the undercoat layer are conducted in the same manner as in Example 1.

Subsequently, 1 part by weight of chlorogallium phthalocyanine having strong diffraction peaks at Bragg angles (2θ±0.2°) of 7.4°, 16.6°, 25.5°, and 28.3° in an X ray diffraction spectrum is mixed with 1 part by weight of polyvinyl butyral (trade name; S-LEC BM-S, manufactured by Sekisui Chemical Co., Ltd.), 0.01 part by weight of 2,4,7,9-tetramethyl-5-decyne-4,7-diol, and 100 parts by weight of n-butyl acetate, and the mixture is treated with glass beads in a paint shaker for 1 hour to form a dispersion, thereby making a coating solution for forming a charge generating layer. No aggregation of the charge generating material is detected in the coating solution. The coating solution is applied onto the undercoat layer by dip coating, and the coating is dried by heating at 100° C. for 10 minutes to form a charge generating layer having a film thickness of about 0.15 μm.

Subsequently, a charge transporting layer is formed in the same manner as in Example 1, whereby photoreceptor 2 is obtained.

Then, evaluation tests on the characteristics are conducted in the same manner as in Example 1. The results are shown in Table 1.

Example 3

—Production of Photoreceptor 3—

The steps leading up to the formation of the undercoat layer are conducted in the same manner as in Example 1. Subsequently, 1 part by weight of hydroxygallium phthalocyanine having strong diffraction peaks at Bragg angles (2θ±0.2°) of 7.5°, 9.9°, 12.5°, 16.3°, 18.6°, 25.1°, and 28.3° in an X ray diffraction spectrum is mixed with 1 part by weight of polyvinyl butyral (trade name: S-LEC BM-S, manufactured by Sekisui Chemical Co., Ltd.), 0.01 parts by weight of 2,4,7,9-tetramethyl-5-decyne-4,7-diol, and 100 parts by weight of n-butyl acetate, and the mixture is treated with glass beads in a paint shaker for 1 hour to form a dispersion, thereby making a coating solution for forming a charge generating layer. No aggregation of the charge generating material is detected in the coating solution. No aggregation of the charge generating material is detected in the coating solution. The coating solution is applied onto the undercoat layer by dip coating, and the coating is dried by heating at 100° C. for 10 minutes to form a charge generating layer having a film thickness of about 0.15 μm.

Subsequently, a charge transporting layer is formed in the same manner as in Example 1, whereby photoreceptor 3 is obtained.

Then, evaluation tests on the characteristics are conducted in the same manner as in Example 1. The results are shown in Table 1.

Example 4

—Production of Photoreceptor 4—

A photoreceptor (photoreceptor 4) is produced in the same manner as in Example 3, except that the amount of 2,4,7,9-tetramethyl-5-decyne-4,7-diol is changed to 0.22 part by weight. No aggregation of the charge generating material is detected in the coating solution for forming a charge generating layer obtained in Example 4. Then, characteristic evaluation test is conducted in the same manner as in Example 1. The results are shown in Table 1.

Example 5

—Production of Photoreceptor 5—

The steps leading up to the formation of the undercoat layer are conducted in the same manner as in Example 1.

Subsequently, a charge generating layer and a charge transporting layer are formed in this order in the same manner as in Example 3 except that SURFYNOL 440 (manufactured by Shin-Etsu Chemical Co., Ltd.) is used in place of 2,4,7,9-tetramethyl-5-decyne-4,7-diol, whereby electrophotographic photoreceptor 5 is obtained. No aggregation of the charge generating material is detected in the coating solution for forming a charge generating layer obtained in Example 5.

Then, evaluation tests on the characteristics are conducted in the same manner as in Example 1. The results are shown in Table 1.

Example 6

—Production of Photoreceptor 6—

A photoreceptor is produced in the same manner as in Example 3, except that the amount of 2,4,7,9-tetramethyl-5-decyne-4,7-diol is changed to 0.0002 part by weight, whereby photoreceptor 6 is obtained.

No aggregation of the charge generating material is detected in the coating solution for forming a charge generating layer obtained in Example 6.

Then, evaluation tests on the characteristics are conducted in the same manner as in Example 1. The results are shown in Table 1.

Example 7

—Production of Photoreceptor 7—

The steps leading up to the formation of the undercoat layer are conducted in the same manner as in Example 1.

Subsequently, a charge generating layer and a charge transporting layer are formed in this order in the same manner as in Example 3 except that 2,5-dimethyl-3-hexyne-2,5-diol is used in place of 2,4,7,9-tetramethyl-5-decyne-4,7-diol, and polyvinyl butyral (trade name: S-LEC BM-5, manufactured by Sekisui Chemical Co., Ltd.) is used in place of polyvinyl butyral (trade name: S-LEC BX-S, manufactured by Sekisui Chemical Co., Ltd.), whereby an electrophotographic photoreceptor (photoreceptor 7) is produced.

No aggregation of the charge generating material is detected in the coating solution for forming a charge generating layer obtained in Example 7.

Then, evaluation tests on the characteristics are conducted in the same manner as in Example 1. The results are shown in Table 1.

Example 8

—Production of Photoreceptor 8—

The steps leading up to the formation of the undercoat layer are conducted in the same manner as in Example 1.

Subsequently, a charge generating layer and a charge transporting layer are formed in this order in the same manner as Example 3 except that 4-trimethylsilyl-3-butyne-3-ol is used in place of 2,4,7,9-tetramethyl-5-decyne-4,7-diol, and polyvinyl butyral (trade name: S-LEC BM-1, manufactured by Sekisui Chemical Co., Ltd.) is used in place of polyvinyl butyral (trade name: S-LEC BX-S, manufactured by Sekisui Chemical Co., Ltd.), whereby an electrophotographic photoreceptor (photoreceptor 8) is obtained.

No aggregation of the charge generating material is detected in the coating solution for forming a charge generating layer obtained in Example 8.

Then, evaluation tests on the characteristics are conducted in the same manner as in Example 1. The results are shown in Table 1.

Example 9

—Production of Photoreceptor 9—

The steps leading up to the formation of the undercoat layer are conducted in the same manner as in Example 1.

Subsequently, a charge generating layer and a charge transporting layer are formed in this order in the same manner as in Example 3 except that 3,5-dimethyl-1-hexyne-3-ol is used in place of 2,4,7,9-tetramethyl-5-decyne-4,7-diol, and polyvinyl butyral (trade name: S-LEC BM-1, manufactured by Sekisui Chemical Co., Ltd.) is used in place of polyvinyl butyral (trade name: S-LEC BX-S, manufactured by Sekisui Chemical Co., Ltd.), whereby an electrophotographic photoreceptor (photoreceptor 9) is obtained.

No aggregation of the charge generating material is detected in the coating solution for forming a charge generating layer obtained in Example 9.

Then, evaluation tests on the characteristics are conducted in the same manner as in Example 1. The results are shown in Table 1.

Example 10

—Production of Photoreceptor 10—

The steps leading up to the formation of the undercoat layer are conducted in the same manner as in Example 1.

Subsequently, a charge generating layer and a charge transporting layer are formed in this order in the same manner as Example 3 except that 2-propion-1-ol is used in place of 2,4,7,9-tetramethyl-5-decyne-4,7-diol, and polyvinyl butyral (trade name: S-LEC BM-1, manufactured by Sekisui Chemical Co., Ltd.) is used in place of polyvinyl butyral (trade name: S-LEC BX-S, manufactured by Sekisui Chemical Co., Ltd.), whereby an electrophotographic photoreceptor (photoreceptor 10) is obtained.

No aggregation of the charge generating material is detected in the coating solution for forming, a charge generating layer obtained in Example 10.

Then, evaluation tests on the characteristics are conducted in the same manner as in Example 1. The results are shown in Table 1.

Comparative Example 1

—Production of Comparative Photoreceptor 1—

The steps leading up to the formation of the undercoat layer are conducted in the same manner as in Example 1.

Subsequently, a charge generating layer and a charge transporting layer are formed in this order in the same manner as in Example 1 except that 2,4,7,9-tetramethyl-5-decyne-4,7-diol is not used, whereby an electrophotographic photoreceptor (comparative photoreceptor 1) is obtained.

Then, evaluation tests on the characteristics are conducted in the same manner as in Example 1. The results are shown in Table 1.

Comparative Example 2

—Production of Comparative Photoreceptor 2—

The steps leading up to the formation of the undercoat layer are conducted in the same manner as in Example 1.

Subsequently, a charge generating layer and a charge transporting layer are formed in this order in the same manner as in Example 1 except that ethylene glycol is used in place of 2,4,7,9-tetramethyl-5-decyne-4,7-diol, whereby an electrophotographic photoreceptor (comparative photoreceptor 2) is obtained.

Then, evaluation tests on the characteristics are conducted in the same manner as in Example 1. The results are shown in Table 1.

Comparative Example 3

The steps leading up to the formation of the undercoat layer are conducted in the same manner as in Example 1.

Subsequently, a charge generating layer and a charge transporting layer are formed in this order in the same manner as in Example 1 except that dimethylacetylene dicarboxylate is used in place of 2,4,7,9-tetramethyl-5-decyne-4,7-diol, whereby an electrophotographic photoreceptor (comparative photoreceptor 3) is obtained.

Then, evaluation tests on the characteristics are conducted in the same manner as in Example 1. The results are shown in Table 1.

TABLE 1

| | | Image quality after printing test at high temperature and high humidity | | Image quality after printing test at low temperature and low humidity | | |
|---|---|---|---|---|---|---|
| | Photoreceptor | Image quality evaluation test (1) | Image quality evaluation test (2) | Image quality evaluation test (1) | Image quality evaluation test (2) | Variation in charging potential |
| Example 1 | Photoreceptor 1 | A | A | A | A | A |
| Example 2 | Photoreceptor 2 | A | A | A | A | A |
| Example 3 | Photoreceptor 3 | A | A | A | A | A |
| Example 4 | Photoreceptor 4 | B | A | A | A | A |
| Example 5 | Photoreceptor 5 | A | A | A | A | A |
| Example 6 | Photoreceptor 6 | A | A | B | A | A |
| Example 7 | Photoreceptor 7 | A | A | B | A | A |
| Example 8 | Photoreceptor 8 | A | A | B | A | A |
| Example 9 | Photoreceptor 9 | A | A | B | A | A |
| Example 10 | Photoreceptor 10 | A | A | B | A | A |
| Comparative Example 1 | Comparative photoreceptor 1 | C | B | C | C | C |
| Comparative Example 2 | Comparative photoreceptor 2 | D | B | C | C | C |
| Comparative Example 3 | Comparative photoreceptor 3 | D | D | C | D | C |

What is claimed is:

1. An electrophotographic photoreceptor comprising a conductive support and a photosensitive layer, the photosensitive layer being disposed on the conductive support, and including a plurality of layers, one of the plurality of layers, which is not an outermost layer of the photosensitive layer, including at least a charge generating material and a compound having a triple bond and a hydroxyl group represented by the following Formula (A-1):

(A-1)

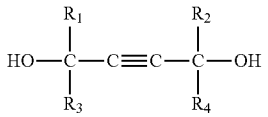

wherein, in Formula (A-1), $R_1$, $R_2$, $R_3$, and $R_4$ —each independently represent an alkyl group, and at least one of $R_1$, $R_2$, $R_3$, and $R_4$ —represents a branched alkyl group.

2. The electrophotographic photoreceptor according to claim 1, wherein $R_1$, $R_2$, $R_3$, and $R_4$ —in Formula (A-1) each represent an alkyl group having 1 to about 20 carbon atoms.

3. The electrophotographic photoreceptor according to claim 1, wherein a content of the compound having a triple bond and a hydroxyl group in the layer including the compound having a triple bond and a hydroxyl group is from about 0.01% by weight to about 10% by weight with respect to the total solid content of the layer.

4. The electrophotographic photoreceptor according to claim 1, wherein a content of the compound having a triple bond and a hydroxyl group in the layer including the compound having a triple bond and a hydroxyl group is from about 0.1% by weight to about 0.5% by weight with respect to the total solid content of the layer.

5. The electrophotographic photoreceptor according to claim 1, wherein the charge generating material is a phthalocyanine pigment.

6. The electrophotographic photoreceptor according to claim 5, wherein the phthalocyanine pigment is a hydroxygallium phthalocyanine pigment having diffraction peaks at Bragg angles (2θ±0.2°) to CuKα characteristic X-rays of 7.5°, 9.9°, 12.5°, 16.3°, 18.6°, 25.1°, and 28.3°.

7. The electrophotographic photoreceptor according to claim 6, wherein a half-value width of the diffraction peak at 7.5° is from about 0.35° to about 1.20°.

8. The electrophotographic photoreceptor according to claim 1, wherein a thickness of the layer containing the charge generating material and the compound having a triple bond and a hydroxyl group is from about 0.1 μm to about 5 μm.

9. The electrophotographic photoreceptor according to claim 1, wherein a thickness of the layer containing the charge generating material and the compound having a triple bond and a hydroxyl group is from about 0.2 μm to about 2.0 μm.

10. The electrophotographic photoreceptor according to claim 1, wherein the charge generating material is titanyl phthalocyanine, chlorogallium phthalocyanine, or hydroxygallium phthalocyanine, and the layer containing the charge generating material and the compound having a triple bond and a hydroxyl group is applied using n-butyl acetate as a solvent.

11. A process cartridge comprising the electrophotographic photoreceptor according to claim 1 and at least one of the following:

a charging unit configured to charge the electrophotographic photoreceptor, a developing unit configured to develop, with a toner, an electrostatic latent image formed on the electrophotographic photoreceptor, so as to form a toner image, and a toner removing unit configured to remove the toner remaining on the surface of the electrophotographic photoreceptor.

12. The process cartridge according to claim 11, wherein the charge generating material is titanyl phthalocyanine, chlorogallium phthalocyanine, or hydroxygallium phthalocyanine, and the layer containing the charge generating material and the compound having a triple bond and a hydroxyl group is applied using n-butyl acetate as a solvent.

13. An image forming apparatus comprising:

the electrophotographic photoreceptor of claim 1, a charging unit configured to charge the electrophotographic photoreceptor, an electrostatic latent image configured to form unit for forming an electrostatic latent image on the charged electrophotographic photoreceptor, a developing unit configured to develop, with a toner, an electrostatic latent image formed on the electrophotographic photoreceptor, so as to form a toner image, and a transfer unit configured to transfer the toner image to a member to which the toner image is to be transferred.

14. The image forming apparatus according to claim 13, wherein the charge generating material is titanyl phthalocyanine, chlorogallium phthalocyanine, or hydroxygallium phthalocyanine, and the layer containing the charge generating material and the compound having a triple bond and a hydroxyl group is applied using n-butyl acetate as a solvent.

* * * * *